US008424291B2

(12) United States Patent
Winter et al.

(10) Patent No.: US 8,424,291 B2
(45) Date of Patent: Apr. 23, 2013

(54) FLAME GLOW PLUG

(75) Inventors: Hayri Winter, Neubulach (DE); Christian Muschik, Nagold (DE); Volker Brichzin, Ludwigsburg (DE); Martin Eller, Ludwigsburg (DE)

(73) Assignees: Friedrich Boysen GmbH & Co. KG, Altensteig (DE); Beru Aktiengesellschaft, Ludwigsburg (DE)

( * ) Notice: Subject to any disclaimer, the term of this patent is extended or adjusted under 35 U.S.C. 154(b) by 605 days.

(21) Appl. No.: 12/564,713

(22) Filed: Sep. 22, 2009

(65) Prior Publication Data

US 2010/0083925 A1 Apr. 8, 2010

(30) Foreign Application Priority Data

Sep. 23, 2008 (DE) ..... 10 2008 048 529

(51) Int. Cl.
*F01N 3/36* (2006.01)
*F01N 3/38* (2006.01)
*F02P 21/00* (2006.01)

(52) U.S. Cl.
USPC ..... 60/286; 60/295; 60/303; 123/144; 123/267; 123/275

(58) Field of Classification Search ..... 60/286, 60/295, 303; 123/144, 267, 275
See application file for complete search history.

(56) References Cited

U.S. PATENT DOCUMENTS

| | | | | |
|---|---|---|---|---|
| 5,417,059 | A * | 5/1995 | Hartel et al. | 60/276 |
| 7,032,376 | B1 * | 4/2006 | Webb et al. | 60/297 |
| 2007/0039315 | A1 * | 2/2007 | Liang | 60/297 |
| 2007/0157606 | A1 * | 7/2007 | Schenck Zu Schweinsberg | 60/285 |

FOREIGN PATENT DOCUMENTS

| | | | |
|---|---|---|---|
| DE | 3734197 | A1 | 4/1989 |
| DE | 42 39 079 | A1 | 5/1994 |
| DE | 20115464 | U1 | 1/2002 |
| DE | 10062956 | A1 | 6/2002 |
| DE | 10-2004-049-048 | A1 | 4/2004 |
| DE | 10-2004-019-659 | A1 | 12/2004 |

(Continued)

OTHER PUBLICATIONS

Kurth, J., et al., "Automation Strategies for a Particle Filter System for Diesel Engines," Control Applications, 1994., Proceedings for the Third IEEE Conference on Glasgow, UK 24-26, USA IEEE, pp. 127-132 (Aug. 1994).

*Primary Examiner* — Erick Solis
(74) *Attorney, Agent, or Firm* — Kilpatrick Townsend & Stockton LLP

(57) ABSTRACT

The present invention relates to a flame glow plug having a combustion chamber which has an outlet opening for the flame, a fuel supply, in particular a blockable fuel supply, for the provision of a fuel flow to the combustion chamber, an air supply for the provision of an air flow to the combustion chamber and an ignition device, in particular an electrically operated heating element, which is arranged in the combustion chamber or which extends into the combustion chamber and which is made to ignite the air/fuel mixture arising from the provided fuel flow and the provided air flow. The air supply is made controllable in quantity to selectively operate the flame glow plug as a torch or as a secondary fuel injection apparatus. The invention furthermore relates to a regeneration apparatus for a particulate filter of an exhaust gas system, to an exhaust gas system for a combustion engine as well as to a method for the operation of a regeneration apparatus.

17 Claims, 2 Drawing Sheets

FOREIGN PATENT DOCUMENTS

Figure 1:
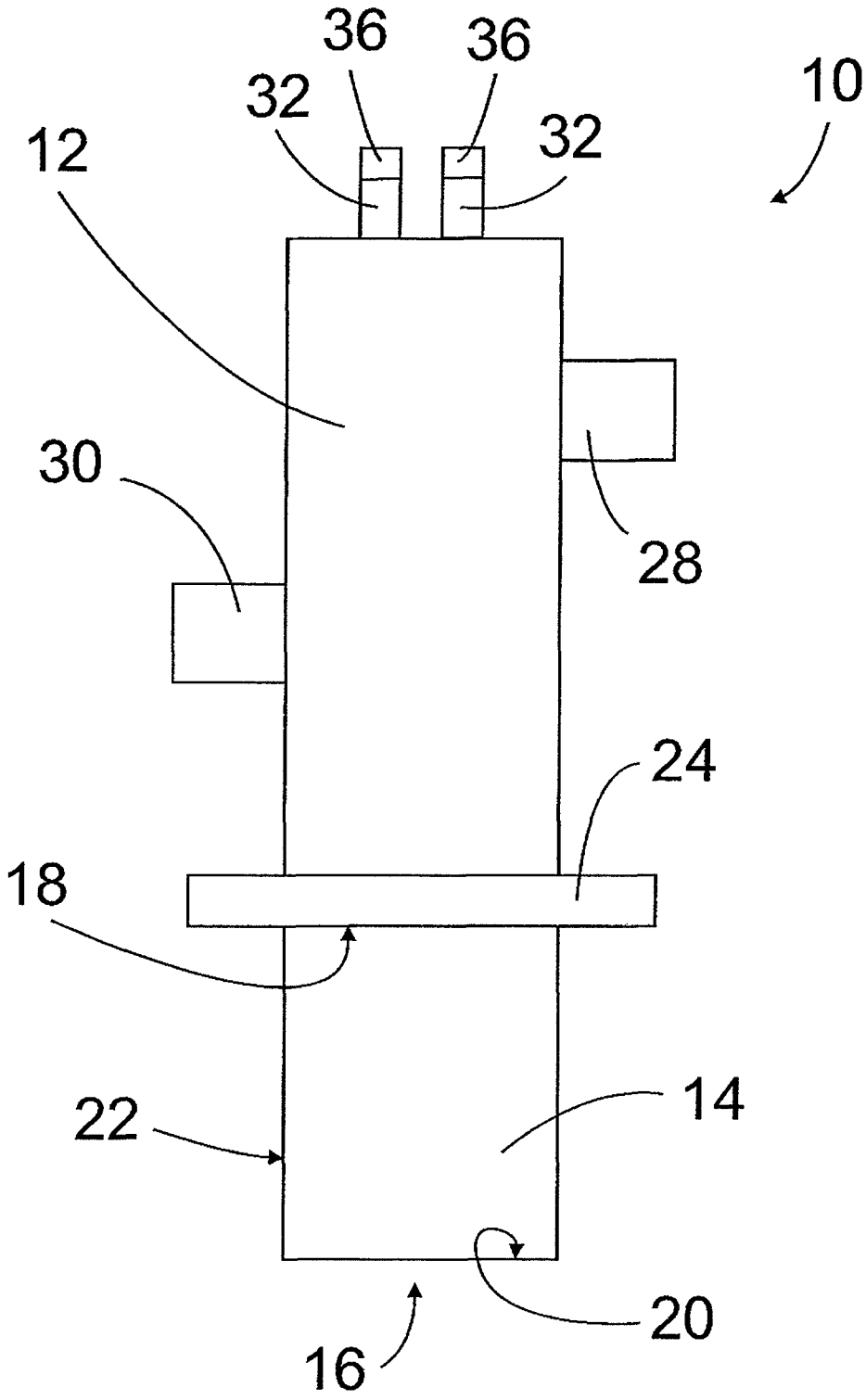

| | | | |
|---|---|---|---|
| DE | 10-2006-015-841 | B3 | 8/2007 |
| FR | 2 893 351 | A1 | 5/2007 |
| WO | WO 2007/141433 | A1 | 12/2007 |

* cited by examiner

FLAME GLOW PLUG

CROSS-REFERENCE TO RELATED APPLICATION

This application claims priority to German Application No. 10 2008 048 529.2, filed Sep. 23, 2008, the disclosure of which is incorporated herein by reference.

The present invention relates to a flame glow plug having a combustion chamber which has an outlet opening for the flame, a fuel supply, in particular a blockable fuel supply, for the provision of a fuel flow to the combustion chamber, an air supply for the provision of an air flow to the combustion chamber and an ignition device, in particular an electrically operated heating element, which is arranged in the combustion chamber or which extends into the combustion chamber and which is made to ignite the air/fuel mixture arising from the provided fuel flow and the provided air flow.

The invention furthermore relates to a regeneration apparatus for a particulate filter of an exhaust gas system, to an exhaust gas system for a combustion engine and to a method for the operation of a regeneration apparatus.

Known flame glow plugs are used as cold start aids for diesel engines, with the air being heated in the intake tract of the engine by the emerging flame.

It is an object of the invention to open up an additional area of use for flame glow plugs.

This object is satisfied by a flame glow plug having the features of claim 1.

In accordance with the invention, the air supply of the flame glow plug is made controllable in quantity. The air supply can in particular be made reducible in quantity and/or blockable. If the air supply is reduced sufficiently to prevent the formation of an air/fuel mixture ignitable by the ignition device, no flame emerges from the combustion chamber. Instead, a meterable fuel flow emerges from the combustion chamber and can be used for corresponding purposes. If the air supply is, however, sufficiently released that an ignitable air/fuel mixture arises in the combustion chamber, this can be ignited by the ignition device. The corresponding flame emerges from the outlet opening and can be used in the usual manner. A flame glow plug in accordance with the invention can thus be operated selectively as a fuel injection apparatus or as a torch.

Such a flame glow plug can in particular be used for the efficient regeneration of a particulate filer in an exhaust gas system of a combustion engine.

Combustion engines emit an exhaust gas flow into the atmosphere, said exhaust gas flow containing different kinds of pollutants. Various apparatus for exhaust gas post-treatment have been developed to reduce the emission of pollutants. For example, catalytic converters are used for the conversion of harmful gaseous substances into harmless components and particulate filters are used for the capturing of unwanted solid particles. The exhaust tract of a diesel engine can, for example, be provided with a diesel oxidizing catalytic converter and a particulate filter arranged downstream thereof. Sooty particles, which are located in the exhaust gas flow are captured by the particulate filter and are stored in it. From a specific quantity onward, the collected soot has to be removed from the particulate filter so that the emission of exhaust gas is not prevented in too unacceptable a manner. This procedure is called regeneration. A common process for regeneration of a particulate filter is to heat the particulate filter to a specific temperature in order thus to burn the deposited soot. This can basically take place by any desired heating apparatus. However, such a heating apparatus must have a relatively high power to heat the particular filter to the ignition temperature of the soot, which has the consequence of an increased demand on energy and installation space.

Other processes have therefore been developed which are based on the principle of secondary fuel injection (HC dosing). In this respect, the fact is utilized that fuel, in particular in the form of non-combusted hydrocarbons, can cause a reaction in the catalytic converter and can thereby heat it. From a specific temperature onward, which is generally called the light-off temperature, an exothermic reaction of the fuel takes place, that is the reaction continues to run independently after the ignition while continuing to release heat. The catalytic converter can be heated sufficiently by the exothermic reaction to heat the particulate filter arranged downstream to the required temperature for the burning off of the deposited soot. No separate heating apparatus is required in this case. The injection of fuel into the exhaust gas flow usually takes place using an injection apparatus which is arranged in direct proximity to the catalytic converter. Alternatively, the injection of the fuel into the exhaust gas flow can also take place within the engine, for example by a subsequent injection of fuel into the combustion space.

However, at catalytic converter temperatures below the light-off temperature, no exothermic reaction takes place so that a particulate filter regeneration by fuel injection is only possible at specific operating states of the combustion engine. There is moreover the problem of an increased fuel consumption.

The catalytic converter can be heated to the light-off temperature at any time with the help of a flame glow plug which is operated as a torch and which is arranged in the vicinity of the catalytic converter. If the temperature of the catalytic converter is above the light-off temperature, the flame glow plug can be used as an apparatus for the secondary fuel injection. In this manner, a regeneration of a particulate filter can be carried out using a flame glow plug in accordance with the invention independently of the catalytic converter temperature, that is independently of the operating state of the combustion engine.

The means for the blocking of the air supply can be provided at the flame glow plug itself or at one of the components arranged before the flame glow plug. A controllable solenoid valve can in particular be arranged at an air supply line or at an air source located remote from the flame glow plug.

A connection stub is preferably provided for the provision of the air flow and an air line which is in particular connected to a compressed air source can be connected to it. The connection stub can be designed in a similar manner as the connection stub for the fuel supply provided with conventional flame glow plugs. The flame glow plug can in this manner be used in different environments using different kinds of compressed air containers, compressors or the like, with only an air line having to be provided having a free end matching the connection stub. The air line can be clamped or screwed to the connection stub or fastened to it in a different manner.

In accordance with a preferred embodiment of the invention, the combustion chamber has a peripheral section closed in an airtight manner, a single end-face inlet opening an a single outlet opening disposed opposite the inlet opening. The combustion chamber thus defines an air closure region, with an inflow of environmental air into the combustion chamber being prevented with a blocked air supply. The fuel flow can only mix with air after an outlet from the combustion chamber. Since, however, the ignition apparatus is not effective outside the combustion chamber, no ignition occurs in this case.

The combustion chamber is preferably formed at least partly by a cylindrical sleeve element with an air impermeable jacket surface. Sleeve elements which are simple to manufacture are also used in conventional flame glow plugs as a combustion chamber surround. However, with known flame glow plugs, holes are provided in the jacket surface of the cylindrical sleeve elements to allow an air inlet into the combustion chamber. By omitting the holes in the sleeve element, the desired air closure space which allows a continued operation of the flame glow plug as an injection apparatus can thus be provided without additional measures.

The flame glow plug is expediently made for attachment in an exhaust gas passage of a combustion engine, in particular of a diesel engine, to be used in the desired manner for the regeneration of a particulate filter in the exhaust gas passage.

A further object of the invention is to design the regeneration of particulate filters in exhaust gas systems more efficiently.

This object is satisfied by a regeneration apparatus for a particulate filter of an exhaust gas system which includes an exhaust gas passage for the leading off of a hot exhaust gas flow from a combustion engine, in particular from a diesel engine, and a catalytic converter, in particular an oxidizing catalytic converter, which is integrated into the exhaust gas passage upstream of the particular filter, with the regeneration apparatus including a torch which is able to heat the catalytic converter to a reaction temperature at which an exothermic reaction of the fuel takes place, with a flame glow plug in accordance with the invention being provided as the torch and the regeneration apparatus at least including a control device which is made to control the air supply of the flame glow plug in dependence on an operating state of the exhaust gas system and/or of the combustion engine. The control device can thus ensure that, when a particular filter regeneration has to be carried out, the flame glow plug is operated, depending on the demand, either as a torch or as an injection apparatus.

The control device is preferably made to release the air supply when the temperature of the catalytic converter is below the reaction temperature and a regeneration of the particulate filter should be carried out. If therefore, for example, the loading of the particular filter with deposited soot particles has reached a degree which requires a regeneration, but if, on the other hand, the temperature of the catalytic converter is too low for an exothermic reaction, since the combustion engine had, for example, just been started, the control device can operate the flame glow plug as a torch by releasing the air supply and thus provide an efficient and fast heating of the catalytic converter to the temperature required for a secondary fuel injection.

The control device is preferably made to reduce or block the air supply when the temperature of the catalytic converter is above the reaction temperature and a regeneration of the particulate filter should be carried out. The flame glow plug is in this case therefore operated as an injection apparatus for the provision of a secondary fuel flow. In this manner, an excessive combustion operation is avoided and the regeneration of the particulate filter can take place in an effective manner via the secondary fuel injection whenever this is possible.

When the temperature of the catalytic converter has increased above the reaction temperature, the control device can again reduce or block the air supply. A switch is therefore automatically made to the more efficient heating principle as soon as the catalytic converter has reached the required temperature.

The object directed to an efficient regeneration of particulate filters in exhaust gas systems is furthermore satisfied by an exhaust gas system for a combustion engine which includes a regeneration apparatus in accordance with the invention.

Furthermore, this object is satisfied by a method for the operation of a regeneration apparatus in accordance with the invention. The method includes the steps that an operating state of the exhaust gas system and/or of the combustion engine is determined and, in dependence on the determined operating state in the case of a regeneration of the particulate filter, an ignitable air/fuel mixture is provided or a provision of an ignitable air/fuel mixture is suppressed. The most effective regeneration principle can thus be selected depending on the then current engine operating point.

A provision of an ignitable air/fuel mixture is preferably suppressed in that the air supply of the flame glow plug is reduced or blocked. If the air supply is restricted so much that no ignitable mixture can form in the combustion chamber, a meterable fuel flow emerges from the outlet opening of the combustion chamber instead of a flame. The ignition apparatus of the flame glow plug can then continue to be operated at reduced or blocked air supply in order, for example, to create or promote an evaporation of the fuel flow in the combustion chamber, whereby the effectiveness of the secondary injection is increased. In a similar manner, a lower quantity of air supply can be provided which is not sufficient to form an air/fuel mixture ignitable by the ignition device to directly influence the properties of the fuel flow emerging from the combustion chamber, in particular to provide oxygen for the following combustion of soot in the particulate filter.

A temperature of the catalytic converter can in particular be determined to deter mine the operating state of the exhaust gas system. Alternatively, an operating parameter of the combustion engine could also be determined, for example the coolant temperature, the speed or the operating time.

An ignitable air/fuel mixture is preferably provided when the temperature of the catalytic converter is below the reaction temperature and a regeneration of the particulate filter should be carried out. The flame glow plug is then operated as a torch and provides a direct heating of the catalytic converter.

In contrast, a provision of an ignitable air/fuel mixture is preferably suppressed when the temperature of the catalytic converter is above the reaction temperature and a reaction should be carried out. The flame glow plug is thus used as an apparatus for the secondary fuel injection and an unnecessary more energy consuming combustion operation is avoided.

The invention will be described in the following by way of example with reference to the drawing.

Figure 2:
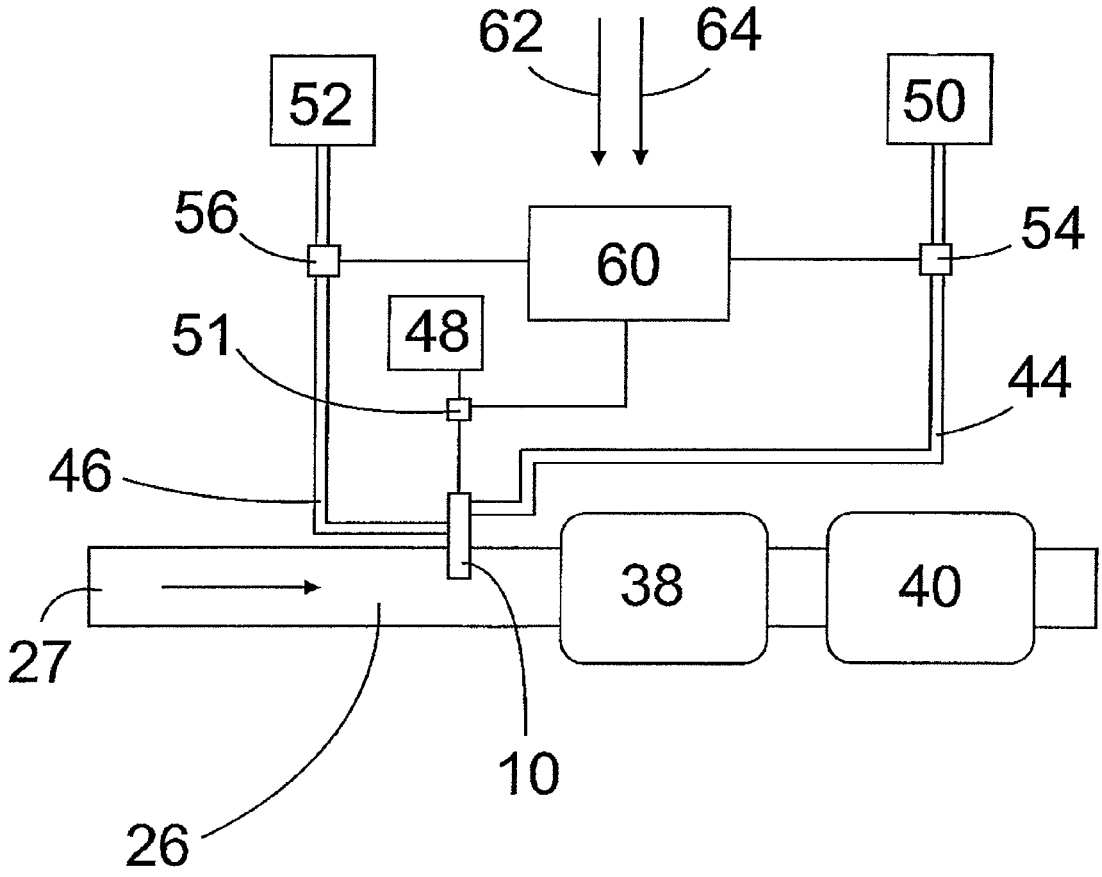

FIG. 1 shows a schematic representation of a flame glow plug in accordance with the invention;

FIG. 2 schematically shows a part of an exhaust gas system which includes a particulate filter and an oxidizing catalytic converter as well as a flame glow plug in accordance with the invention.

The flame glow plug 10 shown in FIG. 1 includes a substantially cylindrical base body 12 at whose one end face a cylindrical sleeve element 14 of a heat-resistant material is arranged. The sleeve element 14 defines a combustion chamber 16 which has an inlet opening 18 facing the base body 12, an outlet opening 20 facing away from the base body 12 and a jacket surface 22.

A fastening flange 24 only shown schematically is provided at the base body 12 which serves to attach the flame glow plug 10 to an exhaust gas passage 26 (FIG. 2) of a combustion engine (not shown) such that the sleeve element 14 projects into the exhaust gas passage 26. A first connection stub 28 for the provision of a fuel flow and a second connection stub 30 for the provision of an air flow are each fastened to the base body 12 or are shaped at it. They each open into a preparation chamber (not shown) in the base body 12 which serves to produce an ignitable air/fuel mixture from the provided fuel flow and the provided air flow. If necessary, additional metering apparatus can also be provided for the metering of the fuel flow and of the air flow in the connection stubs 28, 30 or in the preparation chamber. The exact design of the air/fuel preparation chamber and of the metering apparatus is not important. It is only important that, with a fuel supply to the first connection stub 28 and an air supply to the second connection stub 30, an ignitable air/fuel mixture is emitted to the combustion chamber 16. Two heating bars 32 arranged in parallel are arranged in the base body 12 and each have a glow plug tip (not shown) extending into the combustion chamber 16 and a connection section 36 arranged opposite thereto and guided out of the base body 12. The heating bars 32 can be connected to a controllable electrical energy source by means of the connection sections 36. The number and the performance capability of the heating bars 32 are designed such that, on their activation, the flow of the air/fuel mixture entering into the combustion chamber 16 is ignited and accordingly a flame emerges from the outlet opening 20 of the combustion chamber 16.

As can be recognized from FIG. 1, no holes or openings at all are provided in the jacket surface 22 of the sleeve element 14. The air supply 30 is moreover made controllable in quantity, that is it can be restricted or regulated down so much that the arising of an ignitable air/fuel mixture is prevented. With a blocked air supply 30, and a provided fuel supply 28, a fuel flow enters into the combustion chamber 16, with the fuel flowing in the axial direction, on the one hand, and the jacket surface 22 impermeable to air of the sleeve element 14, on the other hand, preventing any air inlet from the outside into the combustion chamber 16. With a blocked air supply 30, no flame the emerges from the outlet opening 20 of the combustion chamber 16, but rather a metered fuel flow.

A regeneration apparatus for an exhaust gas passage 26 can be realized in an advantageous manner by the flame flow plug 10 shown in FIG. 1, as will be explained in more detail in the following with reference to FIG. 2.

The exhaust gas passage 26 shown in FIG. 2 receives the hot exhaust gas flow from a combustion engine at an end 27 disposed upstream and conducts it onward up to an exhaust end pipe (not shown) through which the exhaust gases are let out into the atmosphere. Before escaping into the atmosphere, the exhaust gas flow, shown by an arrow, passes through a} catalytic converter 38 and a particulate filter 40 for emission control. The catalytic converter 38 can be a common oxidizing catalytic converter such as a diesel oxidizing catalytic converter. The particulate filter 40 is a soot particle filter which filters soot particles contained in the exhaust gas flow from the exhaust gas flow and stores them in its interior. A regeneration apparatus for the particulate filter 40 is arranged upstream of the catalytic converter 38 in the form of a flame glow plug 10.

The flame glow plug 10 is connected via its first connection stub 28 to a fuel line 44 and via its second connection stub 30 to an air line 46. The heating bars 32 of the flame glow plug 10 are connected to an electrical energy source 48, for example a battery. The fuel line 44 is connected to a fuel source 50 shown only schematically and the air line 46 is connected to a compressed air source 52 likewise only shown schematically. A first solenoid valve 54 is arranged in the fuel line 44 and a second solenoid valve 56 is arranged in the air line 46. A controllable electric switch 51 is arranged in the connection line between the electrical energy source 48 and the flame glow plug 10.

The flame glow plug 10 can adopt three different operating states. In accordance with a first operating state, both the fuel supply and the air supply are blocked and the heating bars 32 are not operated. The flame glow plug 10 is thus out of operation in total. In accordance with a second operating state, the fuel supply is released, the air supply is blocked and the heating bars 32 are operated. The flame glow plug 10 is thus operated as a secondary injection apparatus. In accordance with a third operating state, both the air supply and the fuel supply are released and the heating bars 32 are operated. The flame glow plug 10 is operated as a torch in this case.

The control of the individual operating states of the flame glow plug 10 takes place by means of a control device 60 which is connected via electrical control lines to the first solenoid valve 54, to the second solenoid valve 56 and to the electric switch 51. In the embodiment shown, the control device 60 is made as a separate control device which is arranged remote from the flame glow plug 10 and is connected to the respective components via electrical lines. Alternatively, the control device 60 can also be integrated into a control device of the combustion engine.

The control device 60 receives different input signals and controls the operation of the flame glow plug 10 on the basis thereof. The control device 60 in particular receives a catalytic converter temperature signal 62 and a particulate filter charge signal 64. However, a variety of other input signals are conceivable with reference to which a decision can be made whether a regeneration of the particulate filter 40 should be carried out and whether the temperature of the catalytic converter 38 is above the light-off temperature.

If the particulate filter charge signal 64 indicates that regeneration of the particulate filter 40 should be carried out, the control device 60 checks, with reference to the catalytic converter temperature signal 62, whether the temperature of the catalytic converter 38 is below the reaction temperature at which an exothermic reaction of the injected fuel takes place. If this is the case, the flame glow plug 10 is operated as a torch to heat the exhaust gas passage 26 and the catalytic converter 38. The control device 60 then makes a continuous check of the catalytic converter temperature with reference to the catalytic converter temperature signal 62. As soon as the catalytic converter temperature has increased above the reaction temperature, the control device 60 blocks the air supply of the flame glow plug 10 to thereby operate the flame glow plug 10 as an injection apparatus and thus to input uncombusted liquid hydrocarbons into the exhaust gas flow. They react exothermically in the catalytic converter 38, whereby heat is released and the catalytic converter temperature increases. The catalytic converter 38 as well as the particulate filter 40 arranged in direct proximity are heated by the exothermic reaction of the injected fuel up to a temperature which is sufficient to achieve a combustion of the soot particles in the particulate filter 40 and consequently a regeneration of the particulate filter 40.

The means for the blocking of the air supply are present in the shown embodiment, on the one hand, in the sleeve element 14 with a jacket surface 22 impermeable to air and, on the other hand, in the second solenoid valve 56. However, shut-off valves can be used of different types and at different points. For example, the solenoid valve 56 can be located directly at the flame glow plug 10 or at the compressed air source 52. It is only important that the air supply of the flame glow plug can be interrupted or reduced sufficiently in a controlled manner to allow the output of a fuel flow without flame formation at desired time intervals.

It is possible by the regeneration method described above to carry out a regeneration of the particulate filer 40 at any desired times and during any desired operating states of the exhaust gas system or of the combustion engine, that is also, for example, directly after the start of the combustion engine. In a favorable manner, only one single compact component is required for this which is simple to manufacture, namely a flame glow plug 10 in accordance with the invention. A costly and space-consuming heating apparatus is not necessary for the direct heating of the particular filter 40 to the soot combustion temperature. The regeneration concept in accordance with the invention can be used with many different kinds of combustion engines in industrial plant and in the automotive sector.

REFERENCE NUMERAL LIST

10 flame glow plug
12 base body
14 sleeve element
16 combustion chamber
18 inlet opening
20 outlet opening
22 jacket surface
24 fastening flange
26 exhaust gas passage
28 first connection stub
30 second connection stub
32 heating bar
36 connection section
38 catalytic converter
40 particulate filter
44 fuel line
46 air line
48 electrical energy source
50 fuel source
51 switch
52 compressed air source
54 first solenoid valve
56 second solenoid valve
60 control device
62 catalytic converter temperature signal
64 particulate filter charge signal

The invention claimed is:

1. A flame glow plug, comprising:
- a combustion chamber comprising an outlet opening for a flame of the flame glow plug;
- a fuel supply for the provision of a fuel flow to the combustion chamber;
- a controllable air supply for the provision of a controllable quantity of an air flow to the combustion chamber;
- an ignition apparatus disposed at least partly within the combustion chamber, wherein the ignition apparatus is configured to ignite the air/fuel mixture arising from the provided fuel flow and from the provided air flow; and
- a fastening flange configured to attach the flame glow plug directly to an exhaust gas passage such that at least the outlet opening is disposed within, and in fluid communication with, the exhaust gas passage.

2. A flame glow plug in accordance with claim 1 wherein the air supply is reducible in quantity and/or blockable.

3. A flame glow plug in accordance with claim 1, further comprising a controller for the control of the air supply provided at the flame glow plug or upstream of the flame glow plug.

4. A flame glow plug in accordance with claim 1, further comprising a connection stub configured for the provision of the air flow and configured for an air line to be connected to the connection stub.

5. A flame glow plug in accordance with claim 1, wherein the combustion chamber comprises a peripheral section which is closed in an airtight manner, an end-face inlet opening, and an outlet opening disposed opposite the inlet opening.

6. A flame glow plug in accordance with claim 1, wherein the combustion chamber comprises a cylindrical sleeve element having a jacket surface impermeable to air.

7. A flame glow plug in accordance claim 1, wherein the flange is configured to attach the flame glow plug within an exhaust gas passage of a combustion engine.

8. A regeneration apparatus for a particulate filter of an exhaust gas system, the exhaust gas system comprising an exhaust gas passage for expelling a hot exhaust gas flow from a combustion engine; the particulate filter, integrated into the exhaust gas passage; and a catalytic converter integrated into the exhaust gas passage upstream of the particulate filter, wherein the regeneration apparatus comprises:
- a flame glow plug configured to act as a torch which is able to heat the catalytic converter to a reaction temperature at which an exothermic reaction of the fuel takes place, the flame glow plug comprising:
  - a combustion chamber comprising an outlet opening for a flame of the flame glow plug;
  - a fuel supply for the provision of a fuel flow to the combustion chamber;
  - a controllable air supply for the provision of a controllable quantity of an air flow to the combustion chamber; and
  - an ignition apparatus disposed at least partly within the combustion chamber, wherein the ignition apparatus is configured to ignite the air/fuel mixture arising from the provided fuel flow and from the provided air flow;
- at least one control device configured to control the air supply to the flame glow plug in dependence on an operating status of the exhaust gas system and/or of the combustion engine, wherein the control device is configured to reduce or block the air supply when a temperature of the catalytic converter is above a reaction temperature and a regeneration of the particulate filter should be carried out.

9. A regeneration apparatus in accordance with claim 8, wherein the control device is configured to release the air supply when the temperature of the catalytic converter is below the reaction temperature and a regeneration of the particulate filter should be carried out.

10. A regeneration apparatus in accordance with claim 9, wherein the control device is configured to reduce or block the air supply again when the temperature of the catalytic converter has increased above the reaction temperature.

11. An exhaust gas system for a combustion engine, comprising:
- an exhaust gas passage for expelling a hot exhaust gas flow from the combustion engine;
- a particulate filter integrated into the exhaust gas passage;
- a catalytic converter integrated into the exhaust gas passage upstream of the particulate filter
- a flame glow plug configured to act as a torch which is able to heat the catalytic converter to a reaction temperature at which an exothermic reaction of the fuel takes place; and at least one control device configured to control an air supply to the flame glow plug in dependence on an operating status of the exhaust gas system and/or of the combustion engine, wherein the control device is configured to reduce or block the air supply when a temperature of the catalytic converter is above a reaction temperature and a regeneration of the particulate filter should be carried out;

wherein the flame glow plug comprises:

a combustion chamber comprising an outlet opening for a flame of the flame glow plug;

a fuel supply for the provision of a fuel flow to the combustion chamber;

an air inlet configured to provide the air supply to the combustion chamber; and an ignition apparatus disposed at least partly within the combustion chamber, wherein the ignition apparatus is configured to ignite the air/fuel mixture arising from the provided fuel flow and from the provided air flow;

wherein a quantity of the air supply is controllable by the control device.

12. A method for operating a regeneration apparatus for a particulate filter of an exhaust gas system, the exhaust gas system comprising an exhaust gas passage for expelling a hot exhaust gas flow from a combustion engine, the particulate filter integrated into the exhaust gas passage, and a catalytic converter integrated into the exhaust gas passage upstream of the particulate filter, wherein the regeneration apparatus comprises a flame glow plug configured to act as a torch which is able to heat the catalytic converter to a reaction temperature at which an exothermic reaction of the fuel takes place, and at least one control device configured to control the air supply to the flame glow plug in dependence on an operating status of the exhaust gas system and/or of the combustion engine, the method comprising:

determining an operating state of the exhaust gas system and/or of the combustion engine; and in the control device, in dependence on the determined operating state, controlling the air supply to the flame glow plug to either provide or suppress the provision of an ignitable air/fuel mixture to the flame glow plug.

13. A method in accordance with claim 12, wherein suppressing the provision of the ignitable air/fuel mixture comprises reducing or blocking the air supply of the flame glow plug.

14. A method in accordance with claim 13, further comprising operating an ignition apparatus of the flame glow plug while the air supply is reduced or blocked.

15. A method in accordance with claim 12, wherein determining the operating state comprises determining a temperature of the catalytic converter.

16. A method in accordance with claim 12, further comprising providing the ignitable air/fuel mixture when a temperature of the catalytic converter is beneath a reaction temperature and a regeneration of the particulate filter should be carried out.

17. A method in accordance with claim 12, further comprising suppressing the ignitable air/fuel mixture when a temperature of the catalytic converter is above a reaction temperature and a regeneration of the particular filter should be carried out.

* * * * *